US005141415A

United States Patent [19]

Budecker et al.

[11] Patent Number: 5,141,415

[45] Date of Patent: Aug. 25, 1992

[54] PISTON PUMP

[75] Inventors: Ludwig Budecker, Frankfurt am Main; Anton David, Goetzenhain; Hans-Albrecht Guse, Bad Homburg; Ulrich Zutt, Niedernhausen, all of Fed. Rep. of Germany

[73] Assignee: Alfred Teves GmbH, Frankfurt am Main, Fed. Rep. of Germany

[21] Appl. No.: 696,444

[22] Filed: May 6, 1991

Related U.S. Application Data

[62] Division of Ser. No. 466,358, Mar. 6, 1990, Pat. No. 5,030,070.

[30] Foreign Application Priority Data

May 6, 1988 [DE] Fed. Rep. of Germany ..... 3914954
Jul. 7, 1988 [DE] Fed. Rep. of Germany ..... 3822988

[51] Int. Cl.[5] ..... F04B 11/00
[52] U.S. Cl. ..... 417/540

[58] Field of Search ..... 417/540, 42, 543, 435

[56] References Cited

U.S. PATENT DOCUMENTS

| | | | |
|---|---|---|---|
| 2,873,688 | 2/1959 | Elder | 417/542 |
| 3,366,067 | 1/1968 | Kocolowski | 417/540 |
| 3,415,441 | 12/1968 | Kehler | 417/540 |
| 4,629,562 | 12/1986 | Kercher | 417/540 |

*Primary Examiner*—Richard A. Bertsch
*Assistant Examiner*—Charles G. Freay
*Attorney, Agent, or Firm*—Robert P. Seitter; J. Gordon Lewis

[57] ABSTRACT

A piston pump, having at least one delivery plunger to deliver pressure fluid from a suction chamber via a working chamber into a pressure port, is provided with elastic damping elements arranged in the suction chamber to compensate for the occurring pressure pulsations.

2 Claims, 3 Drawing Sheets

PISTON PUMP

This application is a divisional application from U.S. application Ser. No. 07/466,358 filed on Mar. 6, 1990 entitled "PISTON PUMP", now U.S. Pat. No. 5,030,070.

BACKGROUND OF THE INVENTION

The present invention relates to a piston pump having at least one delivery plunger delivering pressure fluid from a suction chamber via a working chamber into a pressure port. Undesirable noises are caused by pressure pulsation in such pumps. For noise reduction, it is known from DE AS 28 24 239 to direct the pressure fluid from the working chamber to the pressure port via a collecting chamber which acts as a vibration damper.

To attenuate vibrations in the suction lines, it is known to use so-called "intake air vessels". However, these intake air vessels bear the shortcoming of necessitating an enormous overall size in order to safeguard an acceptable balance between the flow speed of the suction fluid and the delivered fluid. Furthermore, they become ineffective in the event of high-vacuum venting with subsequent pressure loading.

SUMMARY OF THE INVENTION

Therefore, the instant invention has for its object to accomplish noise attenuation for piston pumps. The invention is characterized by small space requirements, while having optimum damping abilities. The invention is accomplished by simple means at low costs and lends itself to ease of maintenance. The invention is suitable for use on pumps which are vacuum-vented prior to pressure loading.

This object is achieved, according to the present invention, by arranging elastic damping elements in the suction chamber. In this way, the pressure vibrations in the suction area of the pump are compensated directly where they are caused.

A preferred embodiment of this invention provides an elastic damping element that is formed by at least one deformable shaped part which contains at least one closed gas-filled compartment. In a particularly economical embodiment of this invention, the deformable shaped part is made of closed-cell foam material or rubber. In this way, the elastic means can be easily adapted to the existing suction chamber geometry.

Another embodiment of this invention provides an elastic damping element that is a movable wall which confines a gas chamber within the suction chamber. Thus, for instance, mounting of a diaphragm into the suction area permits effective noise attenuation in a simple fashion.

Another advisable embodiment of this invention arranges the damping element as an annularly closed rubber hose. This provides a large damping surface, and the damping element can be easily inserted and held in the suction chamber. For guiding purposes and for obtaining a defined deformability, the damping element cooperates with the ring filter element. The filter element is furnished with web-like retaining arms which receive the damping element partially embracing it at a radial distance. The webs are almost evenly spaced from each other, and the wall confining the suction chamber contributes to securing the damping element in position. This ensures ease of assembly, disassembly and quick exchangeability.

Further advantageous features, as well as the function of this invention, can be understood from the following description with reference to the accompanying drawings.

DETAILED DESCRIPTION OF THE PREFERRED EMBODIMENTS

Figure 1:
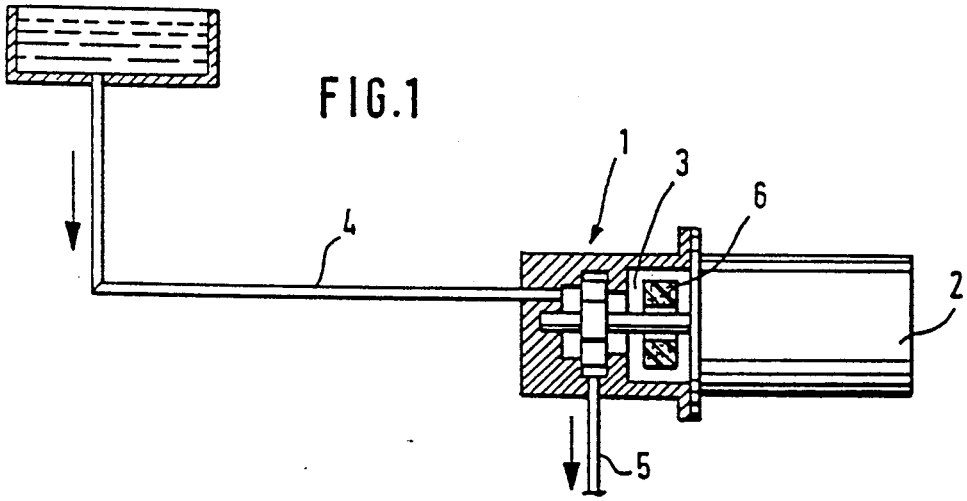
FIG. 1 shows the principal structure of a first embodiment of this invention.
Figure 5:
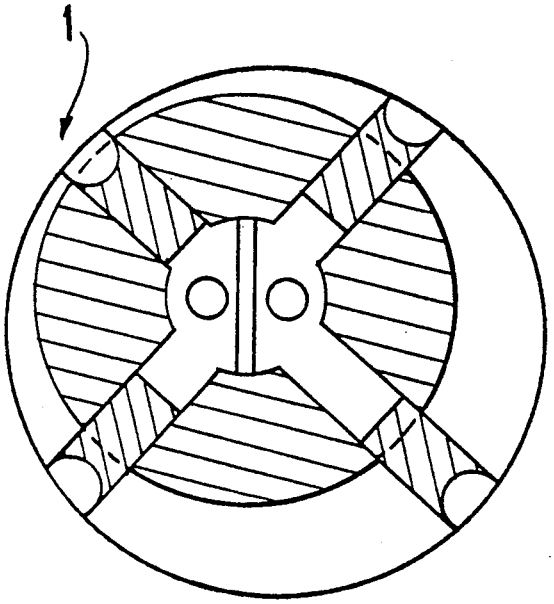
FIG. 5 is a cross-sectional view of the radial piston pump of FIG. 1.

FIGS. 1 and 5 depicts schematically a radial piston pump 1 flanged to an electric motor 2. This radial piston pump 1 delivers fluid out of a reservoir into the pressure line 5 via the suction chamber 3 and the suction line 4.

To compensate for pulsation of the suction pressure, an elastically deformable shaped part 6 is arranged in the suction chamber 3 which is composed of foam material with closed air bubbles or gas bubbles. The geometry of this shaped part 6 is dictated by the special space conditions in the suction area of the pump. In lieu of any foam material, a shaped part can also be used which, instead of a plurality of bubbles, comprises only one or more specially shaped air compartments or gas compartments.

Figure 2:
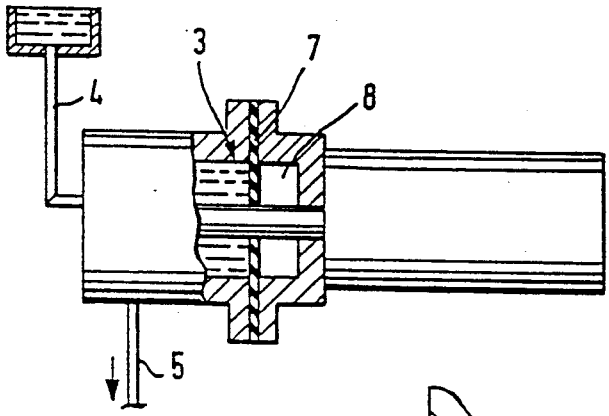
FIG. 2 shows the design of a second embodiment of this invention.

The embodiment shown in FIG. 2 provides a diaphragm 7 as an elastic means in the suction chamber 3. The diaphragm forms a closed compartment 8 in the suction chamber 3, that is preferably filled with air. The compressibility of the air permits compensation for suction pressure pulsations.

Figure 3:
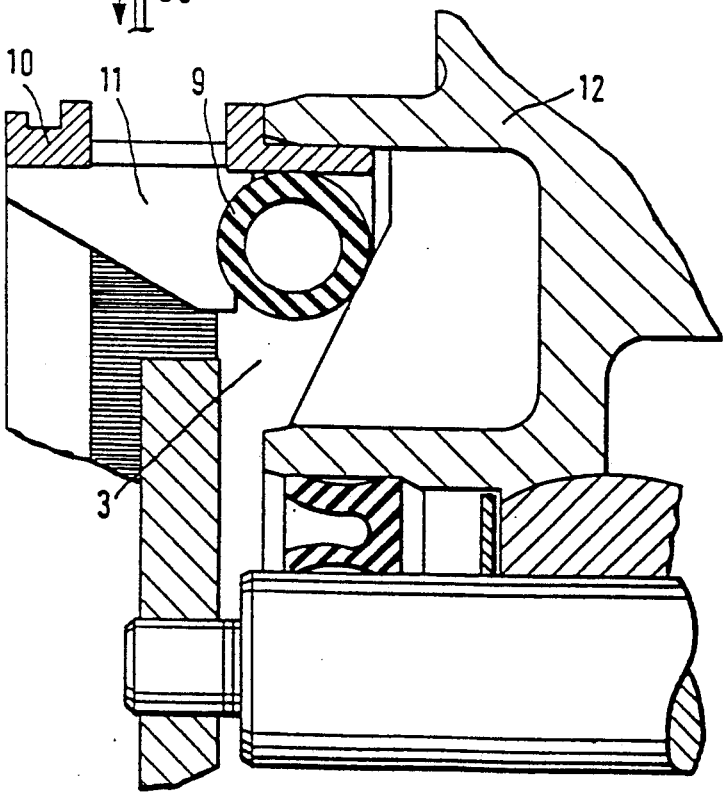
FIG. 3 is a specific embodiment according to FIG. 1.

The inventive embodiment illustrated in FIG. 3 shows an annularly extending damping hose 9 arranged in the suction chamber 3. The damping hose 9 is fixed by the annular filter element 10 arranged in the suction chamber 3. To this end, the filter element 10 is furnished with several retaining arms 11 distributed over the periphery of the filter element partially encompassing the damping hose 9, thereby clamping it between the filter element 10 and the adjoining wall in the housing 12. The damping hose 9 is designed as a component part assembled at its two ends, or it can be composed of several segments which are put together.

Figure 4:
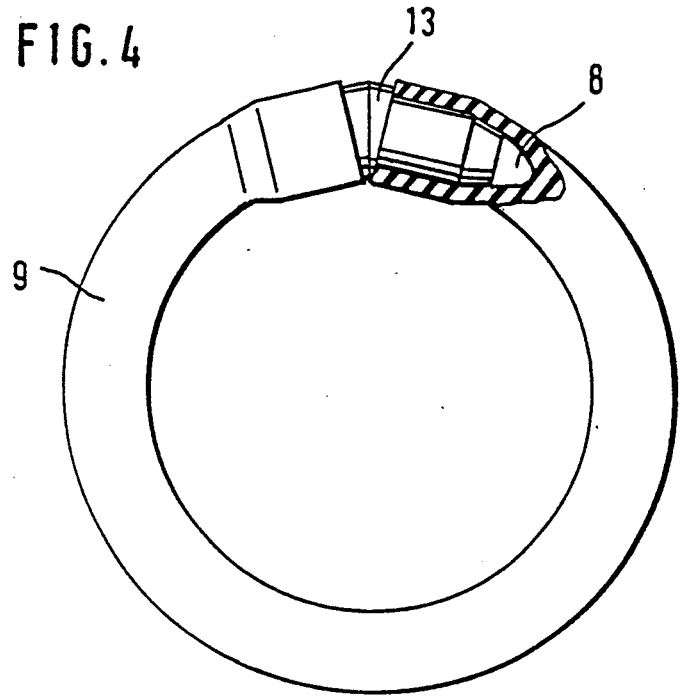
FIG. 4 is a full view of the damping element designed as a damping hose with connecting portions shown in partial cross-section.

FIG. 4 shows a full view of the gas-filled damping hose 9. In the area of the partial cross-section, the obtuse-angularly bent connecting portion 13 is fitted into the two ends of the hose to close the gas-impermeable compartment 8 in the damping hose 9 in a pressure-fluid tight manner. Preferably, the damping hose 9 is made of rubber so that the preloading force of the expanded rubber holds the two hose ends captive on the connecting portion 13 which is chamfered like a truncated cone on both sides.

What is claimed is:

1. A piston pump having at least one delivery plunger delivering pressure fluid from a suction chamber via a working chamber into a pressure port, wherein at least one elastomeric damping element is arranged in the suction chamber, and wherein said elastomeric damping element is formed by at least one deformable shaped part of closed-cell, gas-filled material, said elastomeric damping element defining shaped means for attenuating noise in the piston pump when subjected to vacuum venting prior to pressure loading, and said shaped means being separate, independent and spaced from said at least one delivery plunger.

2. In a piston pump having at least one delivery plunger delivering pressure fluid from a suction chamber via a working chamber into a pressure port, the improvement comprising:

at least one elastomeric damping element arranged in the suction chamber, said elastomeric damping element formed by at least one deformable-shaped part containing at least one closed gas-filled compartment, said shaped part composed of closed-cell foam material.

* * * * *